United States Patent [19]

Sowards

[11] Patent Number: 5,037,113

[45] Date of Patent: Aug. 6, 1991

[54] SOCCER TRAINING DEVICE

[76] Inventor: Gregory E. Sowards, 2916 Fairacres, Las Cruces, N. Mex. 88005

[21] Appl. No.: 565,014

[22] Filed: Aug. 10, 1990

[51] Int. Cl.[5] ..... A63B 69/00

[52] U.S. Cl. ..... 273/411; 273/58 C; 273/413

[58] Field of Search ..... 273/441, 413, 58 C

[56] References Cited

U.S. PATENT DOCUMENTS

| | | | |
|---|---|---|---|
| 4,477,083 | 10/1984 | Sowards | 273/411 |
| 4,720,095 | 1/1988 | Sowards | 273/411 X |
| 4,795,164 | 1/1989 | Morpeau | 273/411 |

*Primary Examiner*—William H. Grieb

*Attorney, Agent, or Firm*—Hoffman, Wasson & Gitler

[57] ABSTRACT

A soccer training device includes a transportable pedestal and a soccer ball connected to the pedestal by a coil spring. The device may be used to practice dribbling.

3 Claims, 1 Drawing Sheet

SOCCER TRAINING DEVICE

This invention relates to sporting equipment, particularly to a soccer training device comprising a portable pedestal and a soccer ball, linked by a spring which permits displacement of the ball, and returns the ball to its initial position.

BACKGROUND OF THE INVENTION

At present, there exist various devices for training and practice of soccer (association football) which in general terms can be described as comprising a soccer ball set up by means of an anchor to a floor.

The connection between the anchor and the soccer ball is achieved in various ways.

One of the ways in which the connection is achieved is by linking the soccer ball to the anchor by means of an elastic cord. A device which uses an elastic cord presents multiple problems, since it requires the use of a very large area, which restricts the number of locations for use, besides the fact that the long elastic cord can become an obstacle which may trip the user. Also, using an elastic cord causes a fixed and slow time of return, which does not adequately train the user for the real game of soccer, particularly dribbling.

Other known soccer training devices involve an elastic panel or barrier placed vertically, against which the user kicks the ball. This barrier device also requires a very large area, which restricts the number of locations where it can be used.

Another known training device includes a bag, which contains a soccer ball, mounted flexibly on a springboard, which constitutes the playing surface on which the user kicks the bag containing the ball. This springboard device can be used in small areas, but it presents the disadvantage that the hook-up or fastening which attaches the bag to the soccer ball presents difficulties.

Another known training device consists of a bag containing a soccer ball, fixed on an anchor to the floor by means of an elastic element. Manufacturing this bag becomes considerably onerous economically, and it is even anticipated that the bag may be replaced by a series of restraining straps, which will undoubtedly not provide great stability for the soccer ball when it is kicked.

SUMMARY OF THE INVENTION

The invention is directed to a soccer training device which comprises a transportable pedestal to which a soccer ball is fixed directly by means of an elastic element.

The pedestal, which is shaped like a hollow truncated cone, may be very heavy or have available sufficient interior space to be filled with the necessary ballast.

The soccer ball, which can be kicked and returns immediately to its original position, is affixed by means of a spring element to the above-mentioned pedestal, which is easily transportable and occupies a small space.

BRIEF DESCRIPTION OF THE DRAWINGS

In the accompanying drawings.

DESCRIPTION OF THE PREFERRED EMBODIMENT

Figure 1:
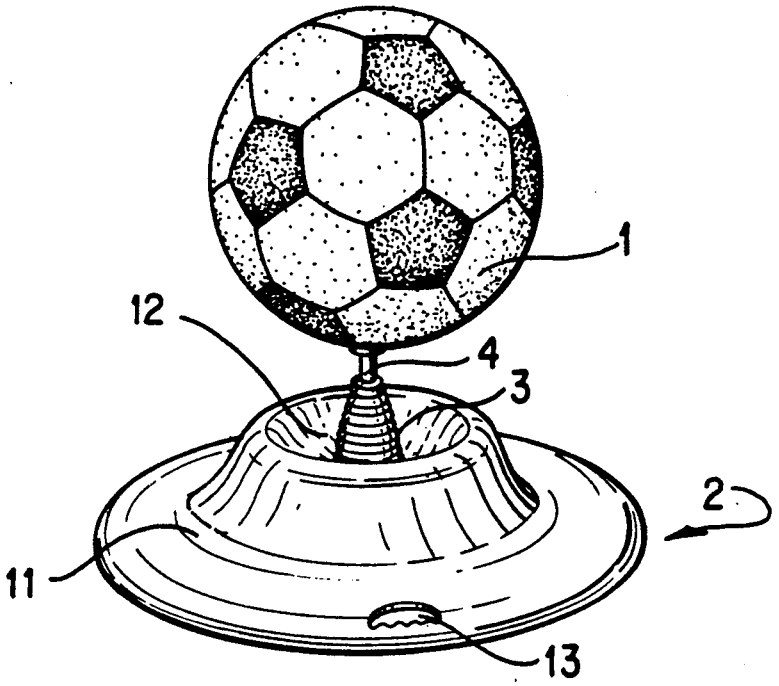
FIG. 1 is a perspective view of a soccer training device embodying the invention.
Figure 2:
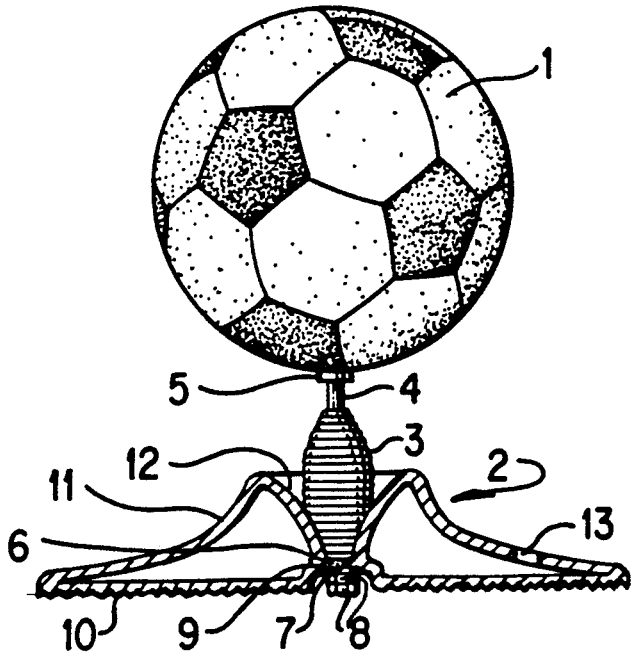
FIG. 2 is a side elevation, in partial section, of the device shown in FIG. 1.

A soccer training device embodying the invention comprises a soccer ball 1 and a transportable pedestal 2.

The pedestal 2 and the soccer ball 1 are linked by a coil spring 3, which is preferably tapered at both ends, as shown.

The joint between the coil spring 3 and the soccer ball 1 is achieved by the installation of a stem 4 which penetrates into the ball 1 and is fixed on the inside of the ball by one nut, and on the outside of the ball by another nut 5, while the other end of the stem 4 is affixed inside the upper end of the coil spring 3.

The coil spring 3 surrounds another protruding stem 6 in its lower end, this stem being fixed to a central seat 9 in the circular base 10 of the pedestal 2, by means of a washer 7 and two nuts 8.

The pedestal is made as a hollow body whose exterior is shaped as a truncated cone 11 having a concave profile. The upper surface of the pedestal has, at its center, a recess whose surface 12 also has a truncated conical shape, but with an upwardly convex profile. The bottom of the base has a seat 9 where a lock washer 7 is affixed together with nuts 8 and the stem 6 of the lower end of the coil spring 3.

The pedestal 2 has on its external surface 11 an indentation 13 which works as a handle for transporting the entire device.

The pedestal 2 may itself have a weight which permits kicking the ball without moving the pedestal at all, or it may also have in its interior sufficient space to contain ballast which permits fixing the device as a whole in one place, so that it cannot move when the soccer ball 1 is kicked.

With this structure, the player will be able to kick continuously (dribble) the soccer ball 1, which because of its elastic attachment through the coil spring 3, will tend to strike the concave surface 11 of the pedestal, then rebound and return to its initial position.

With this device, great simplicity is achieved in practice and training, the disadvantages of anchoring to the floor and the use of large areas are also eliminated, and also the device can be transported very easily from one place to another.

Inasmuch as the invention is subject to modifications and variations, it is intended that the foregoing description and the accompanying drawings shall be interpreted as illustrative of only one form of the invention, whose scope is to be measured by the following claims.

I claim:

1. In a soccer training device comprising a soccer ball elastically connected to a retention element, the improvement wherein the retention element is a transportable pedestal comprising a hollow body having a truncated conical shape, with an exterior surface which is upwardly concave, the body further having a recess for an elastic element interconnecting the soccer ball and the pedestal, said recess terminating at a seat at the center of the bottom of the pedestal.

2. The invention of claim 1, wherein the elastic element connecting the soccer ball to the pedestal is a coil spring, the ball being affixed to an upper stem secured within the upper end of the spring, and the pedestal being affixed to a lower stem secured within the lower end of the spring.

3. The invention of claim 1, wherein the pedestal has an indentation on its concave surface which acts as a handle for grasping when transporting the device.

* * * * *